US011828282B2

(12) United States Patent
Byrne

(10) Patent No.: US 11,828,282 B2
(45) **Date of Patent: *Nov. 28, 2023**

(54) SUCTION COVER ASSEMBLY FOR RECIPROCATING PUMPS

(71) Applicant: SPM Oil & Gas Inc., Fort Worth, TX (US)

(72) Inventor: Joseph Byrne, Hudson Oaks, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 74 days.

This patent is subject to a terminal disclaimer.

(21) Appl. No.: 17/459,817

(22) Filed: Aug. 27, 2021

(65) Prior Publication Data

US 2021/0388832 A1 Dec. 16, 2021

Related U.S. Application Data

(63) Continuation of application No. 16/115,507, filed on Aug. 28, 2018, now Pat. No. 11,105,328.

(60) Provisional application No. 62/551,145, filed on Aug. 28, 2017.

(51) Int. Cl.

| | |
|---|---|
| ***F04B 53/16*** | (2006.01) |
| ***F04B 53/06*** | (2006.01) |
| ***F04B 19/22*** | (2006.01) |
| ***F04B 1/0443*** | (2020.01) |
| ***F04B 1/053*** | (2020.01) |
| ***F04B 53/00*** | (2006.01) |

(52) U.S. Cl.

CPC ..... *F04B 53/16* (2013.01); *F04B 1/0443* (2013.01); *F04B 1/053* (2013.01); *F04B 19/22* (2013.01); *F04B 53/007* (2013.01); *F04B 53/06* (2013.01)

(58) Field of Classification Search

CPC .... F04B 1/0443; F04B 1/053; F04B 11/0091; F04B 19/22; F04B 53/007; F04B 53/06; F04B 53/16

USPC ..... 417/454; 92/86

See application file for complete search history.

(56) References Cited

U.S. PATENT DOCUMENTS

| | | | | |
|---|---|---|---|---|
| 3,104,619 | A * | 9/1963 | Swarthout | F04B 53/143 92/87 |
| 3,259,075 | A * | 7/1966 | Roth | F04B 53/1027 92/169.1 |
| 3,293,994 | A * | 12/1966 | Napolitano | F16J 10/00 92/60 |
| 3,430,575 | A | 3/1969 | Roth | |
| 4,573,886 | A | 3/1986 | Maasberg et al. | |

(Continued)

*Primary Examiner* — Devon C Kramer
*Assistant Examiner* — Joseph S. Herrmann
(74) *Attorney, Agent, or Firm* — Foley & Lardner LLP

(57) ABSTRACT

A suction cover assembly for a reciprocating pump includes a suction cover nut having a nut face and a thread configured to threadably connect the suction cover nut to a fluid cylinder of the reciprocating pump. The suction cover assembly includes a suction cover having a cover face. The suction cover is configured to be held by the fluid cylinder such that the cover face opposes the nut face of the suction cover nut. The suction cover includes first and second seals having a leakage trap defined therebetween. The leakage trap is configured to trap leakage pressure during operation of the reciprocating pump. The suction cover includes at least one leakage channel that is configured to channel the leakage pressure from the leakage trap to an interface between the cover face and the nut face.

17 Claims, 9 Drawing Sheets

(56) References Cited

U.S. PATENT DOCUMENTS

| | | | | |
|---|---|---|---|---|
| 7,096,774 | B2 * | 8/2006 | Hellgren | A23L 3/0155 92/183 |
| 7,335,002 | B2 | 2/2008 | Vicars | |
| 7,506,574 | B2 | 3/2009 | Jensen et al. | |
| 11,105,328 | B2 * | 8/2021 | Byrne | F04B 53/16 |
| 2010/0158726 | A1 | 6/2010 | Donald et al. | |
| 2010/0158727 | A1 | 6/2010 | Hawes et al. | |
| 2011/0189040 | A1 * | 8/2011 | Vicars | F04B 53/00 417/559 |

* cited by examiner

Standard Jacoby

| **Standard** F.E. **Female** thread | **Standard** Suction Cover Nut **Male** thread |
|---|---|
| Von Mises PSI | Von Mises PSI |
| 64375 | 80000 |
| Cycles | Cycles |
| 110000 | 109000 |
| Hours Life, 97 RPM 15KSI | Hours Life, 97 RPM 15KSI |
| 18.9 | 18.7 |

| Fatigue Curve Values that Kourosh used: | Fatigue Curve Values that Kourosh used: |
|---|---|
| **Jacoby F.E.** | **Jacoby Nut** |
| **FEMALE** Thread root Von Mises PSI | **MALE** Thread root Von Mises PSI |
| 50625 | 60000 |
| Cycles to Fatigue | Cycles to Fatigue |
| 152000000 | 12000000 |
| Life Hours, 97 RPM 15KSI | Life Hours, 97 RPM 15KSI |
| 26116 | 2061 |

FIG. 8

SUCTION COVER ASSEMBLY FOR RECIPROCATING PUMPS

CROSS-REFERENCE TO RELATED APPLICATIONS

This application is a continuation of U.S. patent application Ser. No. 16/115,507 filed on Aug. 28, 2018, which claims priority to and the benefit of U.S. Provisional Patent Application Ser. No. 62/551,145 filed on Aug. 28, 2017, which are incorporated herein by reference in their entireties for all intents and purposes.

TECHNICAL FIELD

This disclosure relates to reciprocating pumps, and, in particular, to suction cover assemblies used in reciprocating pumps.

BACKGROUND OF THE DISCLOSURE

In oilfield operations, reciprocating pumps are used for different applications such as fracturing subterranean formations to drill for oil or natural gas, cementing the wellbore, or treating the wellbore and/or formation. A reciprocating pump designed for fracturing operations is sometimes referred to as a "frac pump." A reciprocating pump typically includes a power end and a fluid end (sometimes referred to as a cylindrical section). The fluid end is may be formed of a one piece construction or a series of blocks secured together by rods. The fluid end includes a fluid cylinder having an opening for receiving a plunger or plunger throw, an inlet valve, an outlet valve, and an access port. Reciprocating pumps are oftentimes operated at pressures of 10,000 pounds per square inch (psi) and upward to 25,000 psi and at rates of up to 1,000 strokes per minute or even higher during fracturing operations.

The access port of reciprocating pumps is used to service the plunger and the inlet valve of the reciprocating pump, for example during field use where rapid maintenance and/or replacement may be important for the profitability of a well service operation. In the fluid cylinder of a reciprocating pump, the access port may be closed using a suction cover that is held in place with a suction cover nut that is threadably connected to the fluid cylinder, for example using buttress threads. But, despite the selection of relatively strong materials and the use of double shot peening and/or other hardening techniques, the high cyclical loads on the suction cover may cause the threads to fatigue and ultimately fail, which may necessitate costly replacement of the suction cover nut and/or cause the reciprocating pump to leak at the access port.

Moreover, the high-pressure cyclical pumping force of the reciprocating pump may cause the seal of the suction cover to cycle. For example, cavitation along the edge of the seal during the suction stroke of the reciprocating pump may cause cycling movement (e.g., deformation and relaxation) of the seal that wears the adjacent sealing surface of the fluid cylinder, which may result in a "washout" that causes the reciprocating pump to leak at the access port (e.g., the suction cover nut may weep well service fluid to the atmosphere through the threads). Wearing of the sealing surface on the fluid cylinder and the resulting washout also may be exasperated by frac sand dust that infiltrates the interface between the suction cover seal and the sealing surface of the fluid cylinder. For example, frac sand is almost as hard as diamond and frac sand dust trapped between the seal and the sealing surface may abrade the sealing surface and cause further loss of sealing surface material.

With the recent advances in longer lasting fluid cylinders (e.g., SPM® Duralast® SS Fluid Cylinders), the failure points of the suction cover nut threads and the suction cover seal are becoming bigger issues, for example as compared to the typical cracking of the fluid cylinder at the crossbores due to the high cyclical fatigue forces of reciprocating pumps.

SUMMARY

This summary is provided to introduce a selection of concepts in a simplified form that are further described below in the Detailed Description. This summary is not intended to identify key features or essential features of the claimed subject matter. Nor is it intended to be used as an aid in determining the scope of the claimed subject matter.

In a first aspect, a suction cover assembly for a reciprocating pump includes a suction cover nut having a thread configured to threadably connect the suction cover nut to a fluid cylinder of the reciprocating pump. The suction cover nut has a nut face. The suction cover assembly also includes a suction cover having a cover face. The suction cover is configured to be held by the fluid cylinder such that the cover face opposes the nut face of the suction cover nut. The suction cover includes first and second seals having a leakage trap defined therebetween. The leakage trap is configured to trap leakage pressure during operation of the reciprocating pump. The suction cover includes at least one leakage channel having a first end portion in fluid communication with the leakage trap and a second end portion that extends through the cover face such that the at least one leakage channel is configured to channel the leakage pressure from the leakage trap to an interface between the cover face and the nut face.

In one embodiment, the at least one leakage channel is configured to channel the leakage pressure from the leakage trap to the interface between the cover face and the nut face such that the leakage pressure preloads the thread of the suction cover nut.

In another embodiment, the leakage pressure trapped by the leakage trap is configured to pressure lock the first and second seals.

In yet another embodiment, the suction cover assembly extends along a central longitudinal axis and the leakage pressure is configured to exert a force on the nut face of the suction cover nut that acts in a direction that is approximately parallel to the central longitudinal axis.

In some embodiments, the suction cover nut includes a bleed-off valve configured to release the leakage pressure from the interface between the cover face and the nut face.

In still other embodiments, the suction cover assembly includes a third seal held between the suction cover and the suction cover nut such that the third seal is configured to at least partially seal the interface between the cover face and the nut face.

In one embodiment, the thread of the suction cover nut comprises a buttress thread.

In yet another embodiment, the suction cover nut includes at least one recess for unthreading the suction cover nut from the fluid cylinder of the reciprocating pump.

In some embodiments, the suction cover includes a flange that is configured to engage a seat of the fluid cylinder of the reciprocating pump when the suction cover is held by the fluid cylinder.

In a second aspect, a reciprocating pump assembly includes a power end portion, and a fluid end portion having a fluid cylinder that includes a pressure chamber and an access port. The access port includes an access port thread. The reciprocating pump assembly also includes a suction cover assembly that includes a suction cover nut having a cover nut thread that is interlocked with the access port thread such that the suction cover nut is threadably connected to the access port of the fluid cylinder. The suction cover nut has a nut face. The suction cover assembly also includes a suction cover having a cover face. The suction cover is held within the access port of the fluid cylinder such that the cover face opposes the nut face of the suction cover nut. The suction cover includes first and second seals having a leakage trap defined therebetween. The leakage trap is configured to trap leakage pressure from the pressure chamber during operation of the reciprocating pump. The suction cover includes at least one leakage channel having a first end portion in fluid communication with the leakage trap and a second end portion that extends through the cover face such that the at least one leakage channel is configured to channel the leakage pressure from the leakage trap to an interface between the cover face and the nut face.

In one embodiment, the at least one leakage channel is configured to channel the leakage pressure from the leakage trap to the interface between the cover face and the nut face such that the leakage pressure preloads the cover nut and access port threads.

In another embodiment, the leakage pressure trapped by the leakage trap is configured to pressure lock the first and second seals.

In still another embodiment, the suction cover assembly extends along a central longitudinal axis and the leakage pressure is configured to exert a force on the nut face of the suction cover nut that acts in a direction that is approximately parallel to the central longitudinal axis.

In some embodiments, the suction cover nut includes a bleed-off valve configured to release the leakage pressure from the interface between the cover face and the nut face.

In some embodiments, a third seal is held between the suction cover and the suction cover nut such that the third seal is configured to at least partially seal the interface between the cover face and the nut face.

In one embodiment, the suction cover nut includes a buttress thread that threadably connects the suction cover nut to the fluid cylinder.

In a third aspect, a method for operating a reciprocating pump includes trapping leakage pressure in a leakage trap between first and second seals of a suction cover of the reciprocating pump, and channeling the leakage pressure from the leakage trap to an interface between a cover face of the suction cover and a nut face of a suction cover nut of the reciprocating pump.

In one embodiment, channeling the leakage pressure from the leakage trap to the interface between the cover face and the nut face includes preloading a thread of the suction cover nut.

In another embodiment, channeling the leakage pressure from the leakage trap to the interface between the cover face and the nut face includes exerting a force on the nut face of the suction cover nut that acts in a direction that is approximately parallel to a central longitudinal axis of the suction cover nut.

In another embodiment, trapping leakage pressure in the leakage trap between the first and second seals of the suction cover includes pressure locking the first and second seals.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments.

FIG. 8 is a table illustrating the results of a fatigue life study comparing the suction cover assembly embodiments described and/or illustrated herein with a standard suction cover assembly design, according to some embodiments.

Corresponding reference characters indicate corresponding parts throughout the drawings.

DETAILED DESCRIPTION

The embodiments described and/or illustrated herein provide a reciprocating pump assembly having a suction cover assembly that may include pressure locked seals and preloaded threads. Embodiments described and/or illustrated herein may provide a reciprocating pump assembly that may require less service, which may limit the downtime of the reciprocating pump assembly and/or reduce costs thereby improving the profitability of a well service or other operation utilizing the reciprocating pump assembly.

Figure 1:
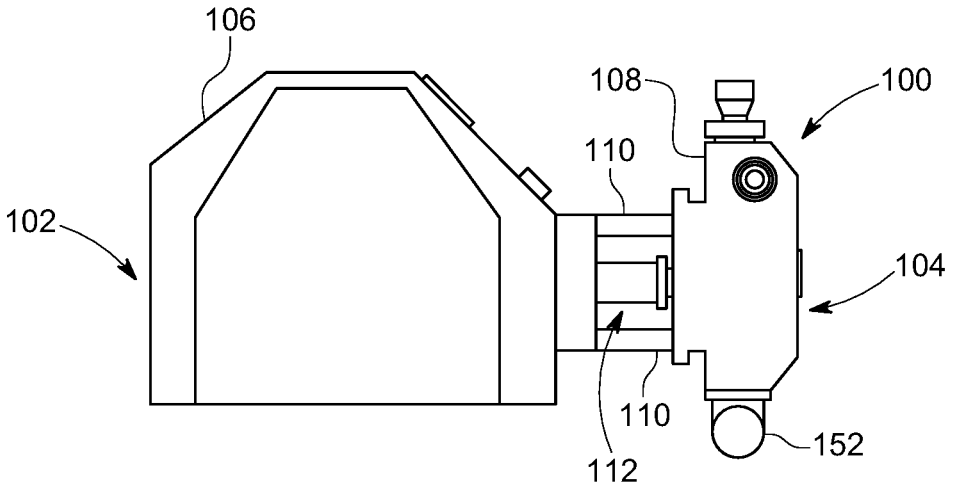
FIG. 1 is an elevational view of a reciprocating pump assembly, according to some embodiments.
Figure 2:
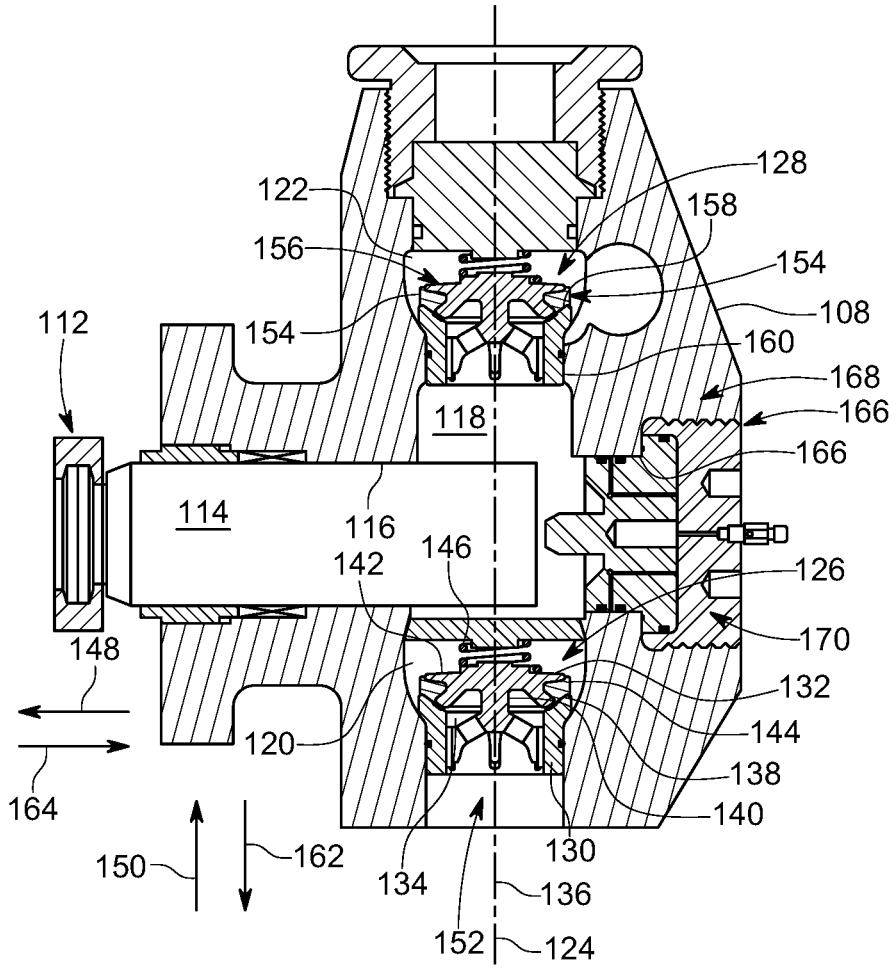
FIG. 2 is a cross-sectional view of a fluid cylinder assembly of the reciprocating pump shown in FIG. 1, according to some embodiments.

Referring to FIGS. 1 and 2, an illustrative embodiment of a reciprocating pump assembly 100 is presented. In FIGS. 1 and 2, the reciprocating pump assembly 100 includes a power end portion 102 and a fluid end portion 104 operably coupled thereto. The power end portion 102 includes a housing 106 in which a crankshaft (not shown) is disposed, the crankshaft is driven by an engine or motor (not shown). The fluid end portion 100 includes a fluid end block or fluid cylinder 108, which is connected to the housing 106 via a plurality of stay rods 110. In operation and as discussed in further detail below, the crankshaft reciprocates a plunger rod assembly 112 between the power end portion 102 and the fluid end portion 104. But the reciprocating pump assembly 100 is not limited to frac pumps or the plunger rod pump discussed herein. The embodiments disclosed herein may be used with any other type of pump that includes an access port. According to some embodiments, the reciprocating pump assembly 100 is freestanding on the ground, is mounted to a trailer for towing between operational sites, is mounted to a skid, and/or the like.

Referring now solely to FIG. 2, the plunger rod assembly 112 includes a plunger 114 extending through a bore 116 and into a pressure chamber 118 formed in the fluid cylinder 108. At least the bore 116, the pressure chamber 118, and the plunger 114 together may be characterized as a "plunger throw." According to some embodiments, the reciprocating pump assembly 100 includes three plunger throws (i.e., a triplex pump assembly); however, in other embodiments, the reciprocating pump assembly 100 includes a greater or fewer number of plunger throws.

In the embodiment illustrated in FIG. 2, the fluid cylinder 108 includes fluid inlet and outlet passages 120 and 122, respectively, formed therein, which are generally coaxially disposed along a fluid passage axis 124. As described in greater detail below, fluid is adapted to flow through the fluid inlet and outlet passages 120 and 122, respectively, and along the fluid passage axis 124.

In the embodiment illustrated in FIG. 2, an inlet valve assembly 126 is disposed in the fluid inlet passage 120 and an outlet valve assembly 128 is disposed in the fluid outlet passage 122. In FIG. 2, the valve assemblies 126 and 128 are spring-loaded, which, as described in greater detail below, are actuated by at least a predetermined differential pressure across each of the valve assemblies 126 and 128. The inlet valve assembly 126 includes a valve seat 130 and a valve body 132 engaged therewith. The valve seat 130 includes a bore 134 that extends along a valve seat axis 136 that is coaxial with the fluid passage axis 124 when the inlet valve assembly 126 is disposed in the fluid inlet passage 120. The valve seat 130 further includes a tapered shoulder 138, which in the exemplary embodiment extends at an angle from the valve seat axis 136.

The valve body 132 includes a tail portion 140 and a head portion 142 that extends radially outward from the tail portion 140. The head portion 142 holds a seal 144 that sealingly engages at least a portion of the tapered shoulder 138 of the valve seat 130. In the exemplary embodiment, the head portion 142 is engaged and otherwise biased by a spring 146, which, as discussed in greater detail below, biases the valve body 132 to a closed position that prevents fluid flow through the inlet valve assembly 126.

In the embodiment illustrated in FIG. 2, the outlet valve assembly 128 is substantially similar to the inlet valve assembly 126 and therefore will not be described in further detail.

With reference to FIG. 2, operation of the reciprocating pump assembly 100 is discussed. In operation, the plunger 114 reciprocates within the bore 116 for movement into and out of the pressure chamber 118. That is, the plunger 114 moves back and forth horizontally, as viewed in FIG. 2, away from and towards the fluid passage axis 124 in response to rotation of the crankshaft (not shown) that is enclosed within the housing 106. Movement of the plunger 114 in the direction of arrow 148 away from the fluid passage axis 124 and out of the pressure chamber 118 will be referred to herein as the suction stroke of the plunger 114. As the plunger 114 moves along the suction stroke, the inlet valve assembly 126 is opened. More specifically, as the plunger 114 moves away from the fluid passage axis 124 in the direction of arrow 148, the pressure inside the pressure chamber 118 decreases, creating a differential pressure across the inlet valve assembly 126, and causing the valve body 132 to move upward in the direction of arrow 150, as viewed in FIG. 2, relative to the valve seat 130. As a result of the upward movement of the valve body 132, the spring 146 is compressed and the seal 144 separates from the tapered shoulder 138 of the valve seat 130 to the open position. Fluid entering through a fluid inlet passage 152 of the fluid cylinder 108 flows along the fluid passage axis 124 and through the inlet valve assembly 126, being drawn into the pressure chamber 118.

To flow through the inlet valve assembly 126, the fluid flows through the bore 134 of the valve seat 130 and along the valve seat axis 136. During the fluid flow through the inlet valve assembly 126 and into the pressure chamber 118, the outlet valve assembly 128 is in a closed position wherein a seal 154 of a valve body 156 of the outlet valve assembly 128 is engaged with a tapered shoulder 158 of a valve seat 160 of the outlet valve assembly 128. Fluid continues to be drawn into the pressure chamber 118 until the plunger 114 is at the end of the suction stroke of the plunger 114, wherein the plunger 114 is at the farthest point from the fluid passage axis 124 of the range of motion of the plunger 114. At the end of the suction stroke of the plunger 114, the differential pressure across the inlet valve assembly 126 is such that the spring 146 of the inlet valve assembly 126 begins to decompress and extend, forcing the valve body 132 of the inlet valve assembly 126 to move downward in the direction of arrow 162, as viewed in FIG. 2. As a result, the inlet valve assembly 126 moves to and is otherwise placed in the closed position wherein the seal 144 of the valve body 132 is sealingly engaged with the tapered shoulder 138 of the valve seat 130.

Movement of the plunger 114 in the direction of arrow 164 toward the fluid passage axis 124 and into the pressure chamber 118 will be referred to herein as the discharge stroke of the plunger 114. As the plunger 114 moves along the discharge stroke into the pressure chamber 118, the pressure within the pressure chamber 118 increases. The pressure within the pressure chamber 118 increases until the differential pressure across the outlet valve assembly 128 exceeds a predetermined set point, at which point the outlet valve assembly 128 opens and permits fluid to flow out of the pressure chamber 118 along the fluid passage axis 124, being discharged through the outlet valve assembly 128. As the plunger 114 reaches the end of the discharge stroke, the inlet valve assembly 126 is positioned in the closed position wherein the seal 146 is sealingly engaged with the tapered shoulder 138 of the valve seat 130.

The fluid cylinder 108 of the fluid end portion 104 of the reciprocating pump assembly 100 includes an access port 166. The access port 166 is defined by an opening that extends through a body 168 of the fluid cylinder 108 to provide access to the pressure chamber 118 and thereby internal components of the fluid cylinder 108 (e.g., the inlet valve assembly 146, the outlet valve assembly 148, the plunger 114, etc.) for service (e.g., maintenance, replacement, etc.) thereof. The access port 166 of the fluid cylinder 108 is closed using a suction cover assembly 170 to seal the pressure chamber 118 of the fluid cylinder 108 at the access port 166. The suction cover assembly 170 may be selectively removed to enable access to the pressure chamber 118 and thereby the internal components of the fluid cylinder 108. In some circumstances (e.g., during field use of the reciprocating pump assembly 100, etc.), it may be desirable to access and thereby service the internal components of the fluid cylinder 108 relatively quickly, for example to limit the downtime of the reciprocating pump assembly 100 wherein the reciprocating pump assembly 100 is non-operational. The capability of servicing the reciprocating pump assembly 100 as quickly as possible and thereby limiting the downtime thereof may improve the profitability of a well service or other operation utilizing the reciprocating pump assembly 100.

Figure 3:
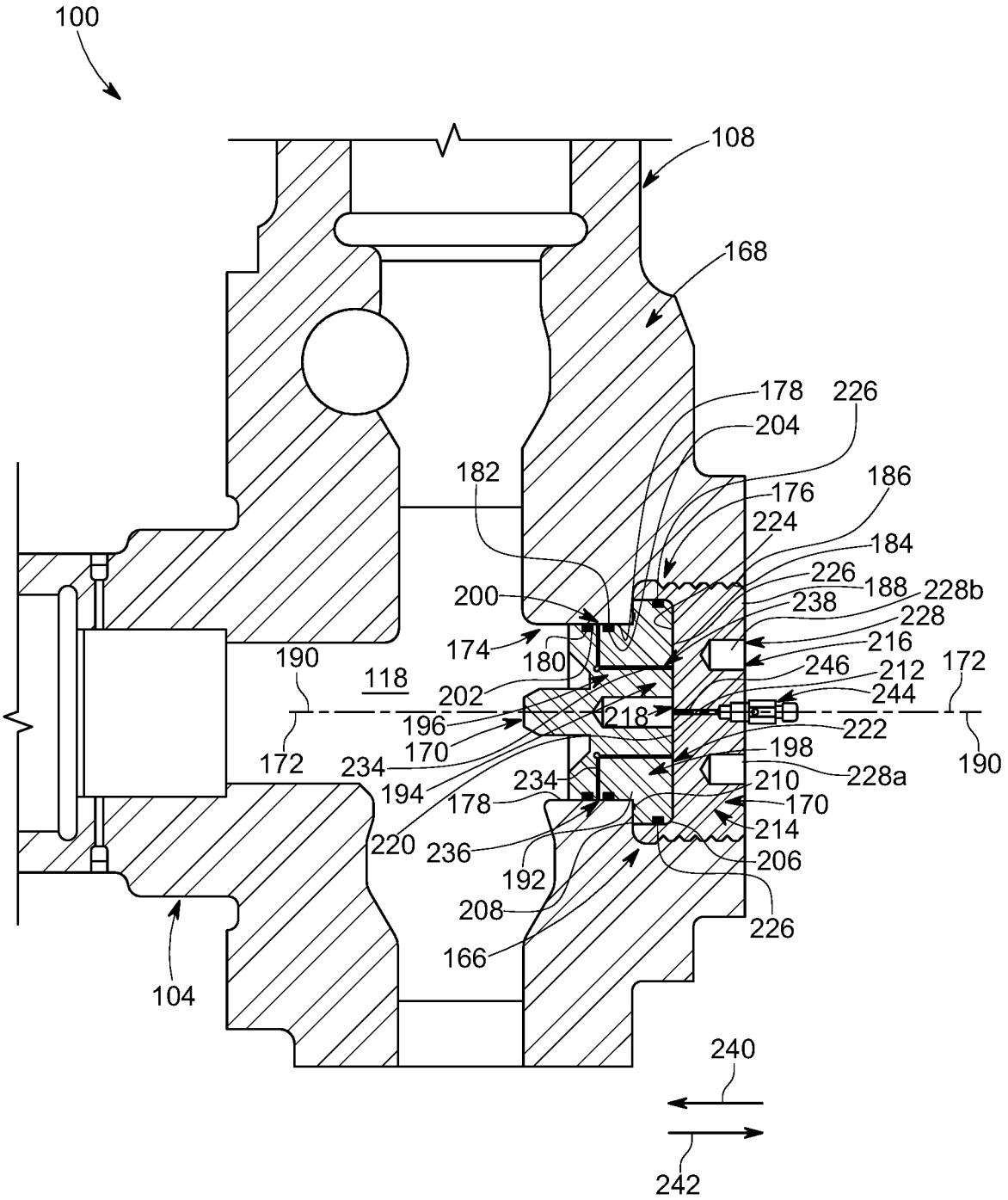
FIG. 3 is a cross-sectional view of the fluid cylinder shown in FIG. 2 illustrating a suction cover assembly, according to some embodiments.
Figure 4:
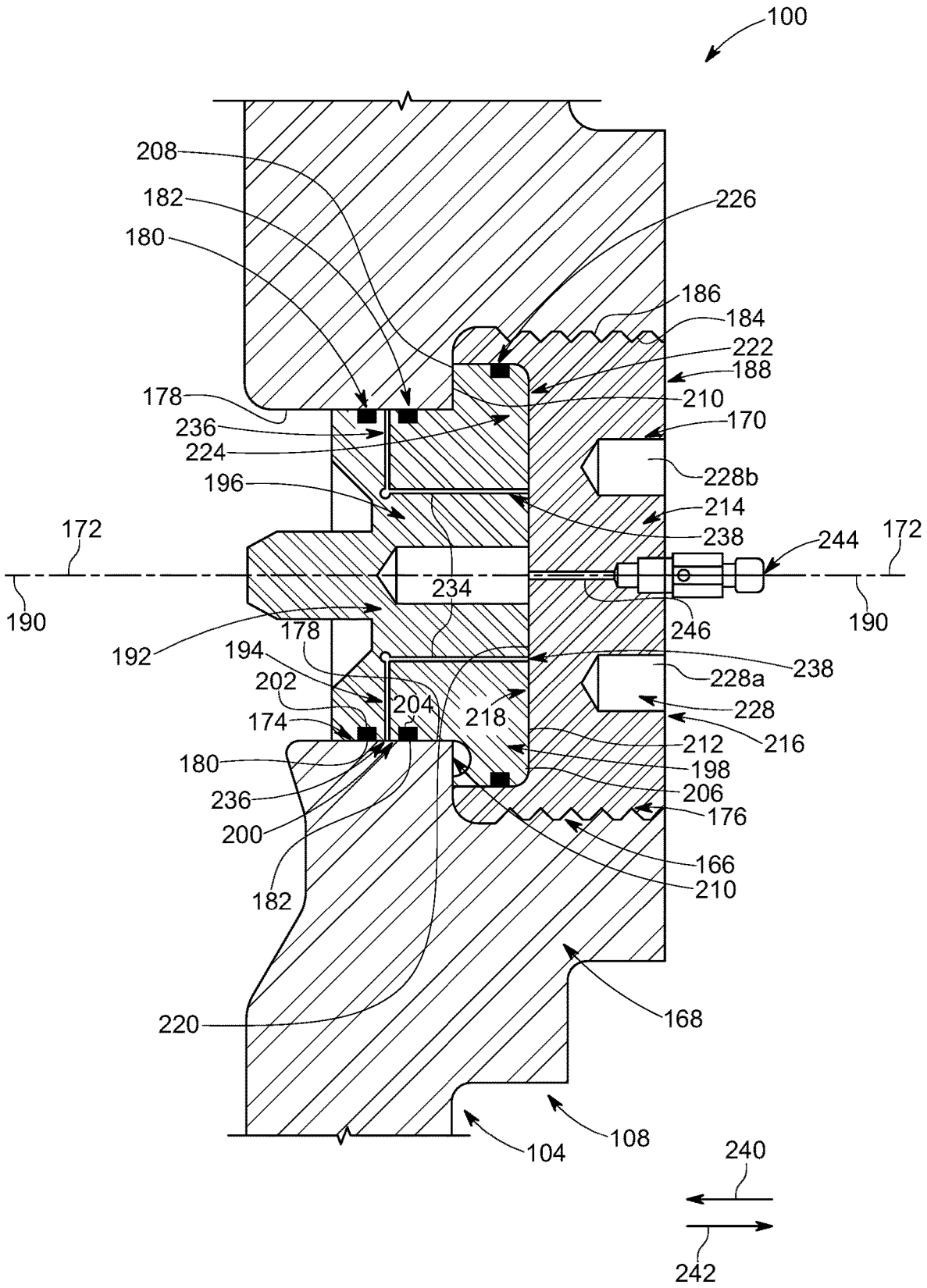
FIG. 4 is an enlarged cross-sectional view of a portion of the fluid cylinder shown in FIG. 3 illustrating the suction cover assembly, according to some embodiments.

The suction cover assembly 100 will now be described with reference to FIGS. 3-5. In FIG. 3, the inlet valve assembly 146 (FIG. 2), the outlet valve assembly 138 (FIG. 2), and the plunger rod assembly 112 (FIG. 2) have been removed from the body 168 of the fluid cylinder 108 for clarity. The access port 166 of the fluid cylinder 108 extends through the body 168 of the fluid cylinder 108 along a central longitudinal axis 172 and includes a cover segment 174 and a nut segment 176. The cover segment 174 includes a sealing surface 178 that is configured to be sealingly engaged by seals 180 and 182 of the suction cover assembly 170, as will be described below. The nut segment 176 includes one or more threads 184 that are configured to interlock with one or more threads 186 of a suction cover nut 188 of the suction cover assembly 170, as will also be described below. The thread(s) 184 of the access port 166 may be referred to herein as an "access port thread," while the thread(s) 186 of the suction cover nut 192 may be referred to herein as an "cover nut thread."

The suction cover assembly 170 extends along a central longitudinal axis 190 that is coaxial with the central longitudinal axis 172 of the access port 166. The suction cover assembly 170 includes a suction cover 192 and the suction cover nut 188. The suction cover 192 includes a body 194 that is held within the access port 166 of the fluid cylinder 108. The body 194 of the suction cover 192 includes a base portion 196 and a head portion 198. As shown in FIGS. 3-5, the suction cover 192 is held within the access port 166 such that the base portion 196 is received within and extends along the cover segment 174 of the access port 166.

The suction cover 192 includes the seals 180 and 182. More particularly, the seals 180 and 182 extend around the circumference of the base portion 196 of the suction cover 192. In some embodiments, each seal 180 and 182 is configured to sealingly engage with the sealing surface 178 of the cover segment 174 of the access port 166 to facilitate sealing the pressure chamber 118 of the fluid cylinder 108 at the access port 166. As will be described in more detail below with reference to FIG. 6, a leakage trap 200 is defined between the seals 180 and 182.

In the illustrated embodiment, the seals 180 and 182 are held within respective grooves 202 and 204 that extend into the base portion 196 of the suction cover 192. But, in addition or alternatively, the seals 180 and/or 182 may be held within one or more grooves (not shown) that extend into the sealing surface 178 of the access port 166. Each seal 180 and 182 may include any material(s) that enables the seal 180 or 182 to function as described and/or illustrated herein to at least partially sealingly engage with the sealing surface 178, for example. a rubber, a plastic, a polymer, a composite material, etc. Operation of the seals 180 and 182 will be described in more detail below with reference to FIG. 6. Each of the seals 180 and 182 may be referred to herein as a "first seal" and/or a "second seal."

Figure 5:
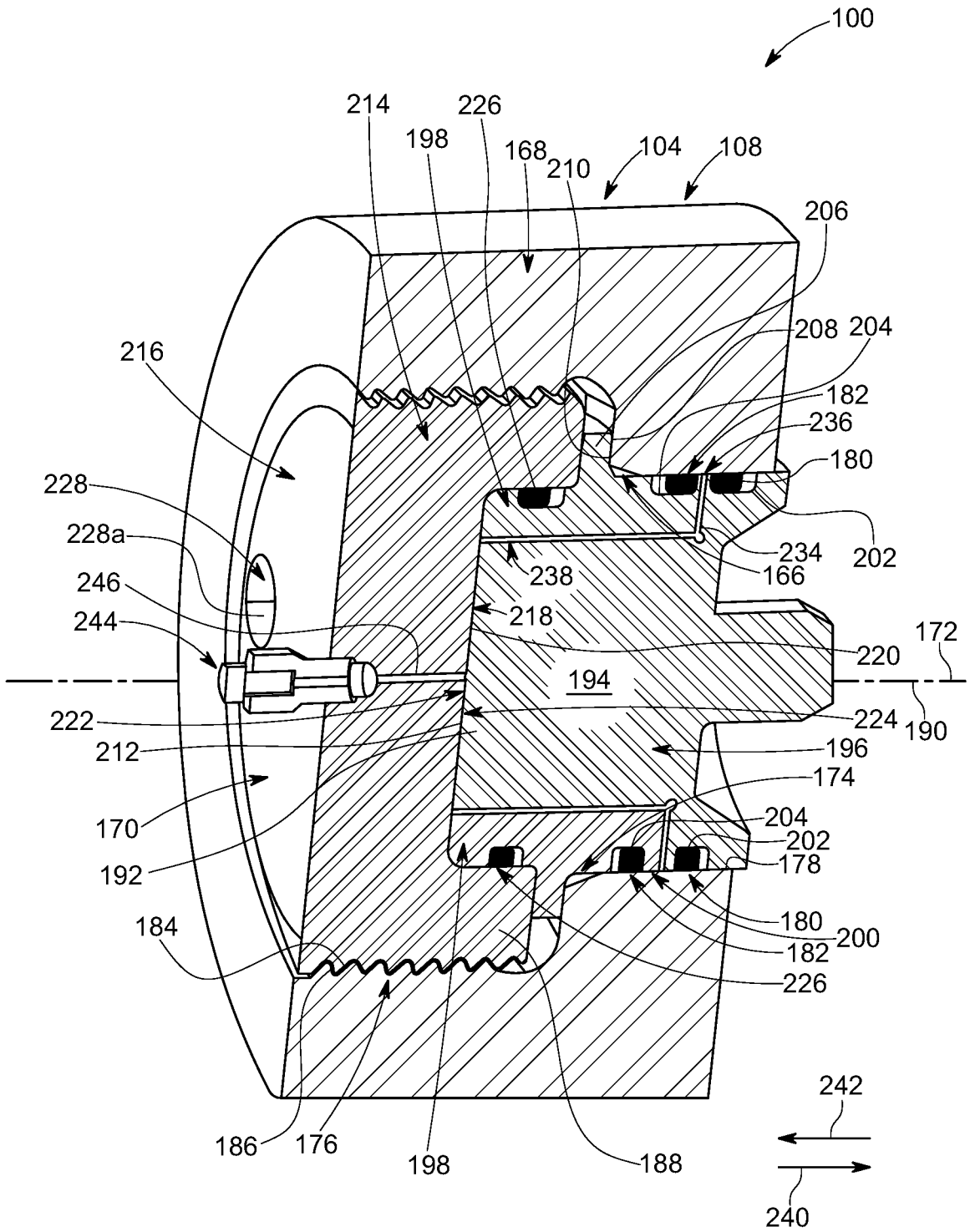
FIG. 5 is a perspective view of a portion of the fluid cylinder shown in FIG. 2 illustrating another cross-sectional view of the suction cover assembly, according to some embodiments.

Although shown in FIG. 5 as having cylindrical shapes and/or circular shapes, the base portion 196 of the suction cover 192, the cover segment 174 of the access port 166, and the seals 180 and 182 each may have any other shape that enables the suction cover 192 to at least partially seal the pressure chamber 118 at the access port 166 (e.g., a parallelepiped shape, a quadrilateral cross-sectional shape, a triangular cross-sectional shape, etc.).

In the exemplary embodiment illustrated herein, the head portion 198 of the suction cover 192 includes a flange 206 that extends radially outward relative to the base portion 196 of the suction cover 192. The flange 206 includes a seat surface 208 and the access port 166 of the fluid cylinder 108 includes a seat 210 that extends between the cover segment 174 and the nut segment 176 of the access port 166. As shown in FIGS. 3-5, the seat surface 208 of the flange 206 engages in physical contact with the seat 210 of the access port 166 of the fluid cylinder 108 when the suction cover 192 is held within the access port 166. The head portion 198 of the suction cover 192 includes a face 212 that faces the suction cover nut 188. The face 212 may be referred to herein as a "cover face."

The suction cover nut 188 includes a body 214 that is configured to hold the suction cover 192 in place within the access port 166. More particularly, the suction cover nut 188 includes the thread(s) 186, which are configured to interlock with the thread(s) 184 of the nut segment 176 of the access port 166 to threadably connect the suction cover nut 188 to the body 168 of the fluid cylinder 108. When threadably connected to the body 168 of the fluid cylinder 108 as shown in FIGS. 3-5, the suction cover nut 188 is positioned within the nut segment 176 of the access port 166 such that the suction cover nut 188 covers the suction cover 192 and thereby holds the suction cover 192 within the cover segment 174 of the access port 166. In the illustrated embodiment shown herein, the threads 184 and 186 of the access port 166 and the suction cover nut 188, respectively, are buttress threads having a pipe (i.e., hydraulic sealing) thread form that is designed to provide a hydraulic seal (e.g., a 7.75 inch British Buttress Modified thread form, etc.). But, any type of thread profile may be used, for example, any type of buttress thread form (e.g., a leadscrew thread profile, a Simple buttress thread form, an ANSI 45°/7° buttress thread form, a 45°/7° British buttress thread form, a 45°/5° buttress thread form, a 33°/3° German saw tooth buttress thread form, etc.), a square thread form, an Acme thread form, etc.

The body 214 of the suction cover nut 188 extends from an exterior end portion 216 to an interior end portion 218. The interior end portion 218 of the suction cover nut 188 includes a face 220 that faces the suction cover 192. More particularly, the suction cover 192 is held by the fluid cylinder 108 (i.e., held within the access port 166 by the suction cover nut 188) such that the face 212 of the suction cover 192 opposes (i.e., faces) the face 220 of the suction cover nut 188. In other words, the faces 212 and 220 of the suction cover 192 and the suction cover nut 188, respectively, oppose each other (i.e., face toward each other). As shown in FIGS. 3-5, an interface 222 is defined between the face 212 of the suction cover 192 and the face 220 of the suction cover nut 188. The face 220 of the suction cover nut 188 may be referred to herein as a "nut face."

In the exemplary embodiment illustrated herein, the head portion 198 of the suction cover 192 is received within a recess 224 of the interior end portion 218 of the suction cover nut 188 when the suction cover assembly 170 is installed within the access port 166. But any other arrangement may be used. For example, in other embodiments the interior end portion 218 of the suction cover nut 188 may be received within a recess (not shown) of the suction cover 192. Moreover, and for example, in another embodiment neither the suction cover 192 nor the suction cover nut 188 is received within a recess of the other.

Optionally, the interface 222 between the faces 212 and 220 of the suction cover 192 and the suction cover nut 188, respectively, is at least partially sealed using a seal 226. In the exemplary embodiment illustrated herein, the seal 226 is held between the suction cover 192 and the suction cover nut 188 such that the seal 226 is configured to at least partially seal the interface 222 between the faces 212 and 220. As shown herein, the seal 226 is held within a groove that extends into the suction cover 192. But, in addition or alternatively, the seal 226 may be held within a groove (not shown) that extend into the suction cover nut 188. The seal 226 may include any material(s) that enables the seal 226 to function as described and/or illustrated herein to at least partially seal the interface 222, for example. a rubber, a plastic, a polymer, a composite material, etc. The seal 226 may be referred to herein as a "third seal."

The suction cover nut 188 includes an actuator 228 that enables the suction cover nut 188 to rotated using a tool for threading the suction cover nut 188 into the access port 166 of the fluid cylinder 108 to thereby install the suction cover nut 188 and for unthreading the suction cover nut to thereby remove the suction cover nut 188 from the access port 166. In the exemplary embodiment illustrated herein, the actuator 228 includes a pair of recesses 228*a* and 228*b* that may be used by a pin spanner wrench to rotate the suction cover nut 188. But, the actuator 228 may include any other number of the recesses 228*a* and 228*b*. Moreover, any other type of actuator may be used that enables the suction cover nut 188 to be rotated using a tool, for example, one or more flats, any other number of recesses (e.g., for reception by a different type of spanner wrench), a screw head for reception of a screw driver, etc.

Figure 6:
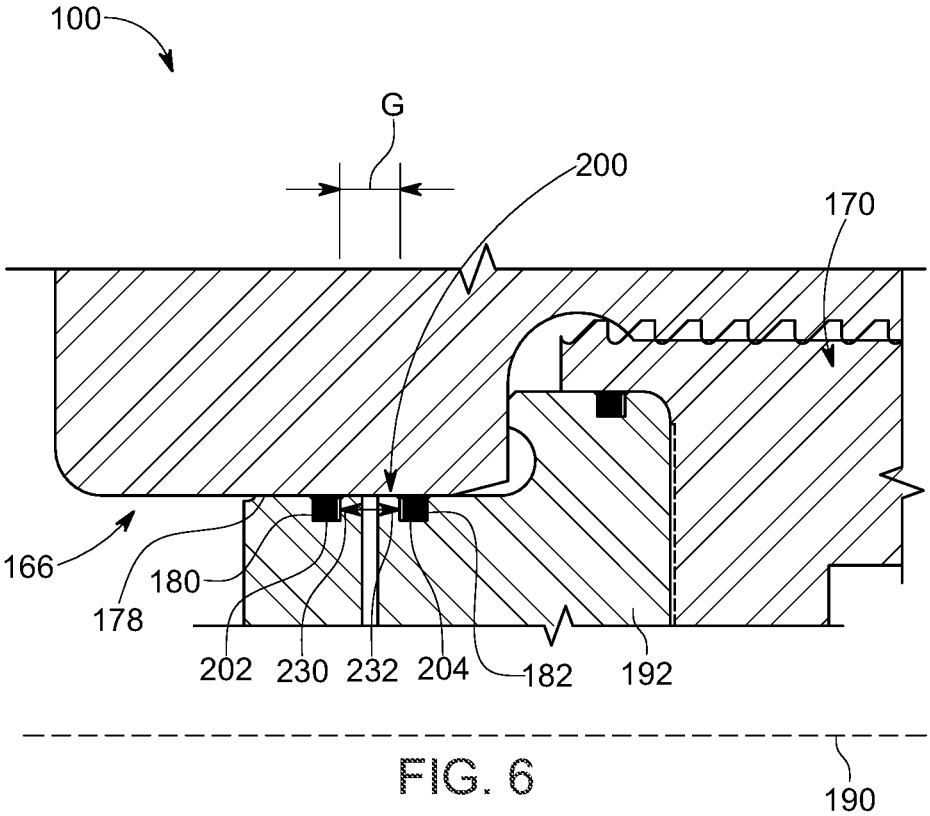
FIG. 6 is an enlarged cross-sectional view illustrating a portion of the suction cover assembly shown in FIGS. 3-5, according to some embodiments.

Referring now to FIG. 6, operation of the seals 180 and 182 will now be described. As briefly described above, a leakage trap 200 is defined between the seals 180 and 182. More particularly, the seals 180 and 182 are spaced apart along the central longitudinal axis 190 of the suction cover assembly 170 such that a gap G is defined between the seals 180 and 182. The space between the seals 180 and 182 defined by the gap G, referred to herein as the leakage trap 200, is configured to trap leakage pressure from the pressure chamber 118 during operation of the reciprocating pump 100. More particularly, the Jacoby Leakage Effect is phenomena wherein the lead seal of a piston having two seals with a space therebetween will leak as the piston is stroked in the discharge stroke of a reciprocating pumping chamber that rapidly cycles between the higher pressure discharge stroke and a lower pressure suction stroke. The leakage from the lead seal becomes trapped in the space between the seals and causes the seals to become "pressure locked." The Jacoby Leakage Effect is also seen in a plunger reciprocating pump that includes two seals that are exposed to pressure during the pumping cycle of the plunger reciprocating pump. Accordingly, during operation of the reciprocating pump assembly 100, the seal 180 will leak pressure into the leakage trap 200 during movement of the plunger 114 (FIG. 2) in the discharge stroke.

The leakage pressure trapped in the leakage trap 200 during the discharge stroke of the plunger 114 pressure locks the seals 180 and 182. As shown in FIG. 6, the pressure lock provided by the leakage pressure trapped by the leakage trap 200 exerts a force on the seal 180 in the direction of the arrow 230 and exerts a force on the seal 182 in the direction of the arrow 232. The forces exerted on the seals 180 and 182 by the pressure lock may reduce or eliminate cycling movement (e.g., deformation and relaxation) of the seals 180 and/or 182 during cycling of the plunger 114 of the reciprocating pump assembly 100 between the higher pressure discharge stroke and the lower pressure suction stroke. The reduction or elimination of such reciprocating cycling movement of the seals 180 and/or 182 may reduce or eliminate wearing of the sealing surface 178 of the access port 166 and the resulting washout. Accordingly, the pressure lock provided by the leakage pressure trapped by the leakage trap 200 may improve the sealing performance of the suction cover assembly 170 and/or extend the life of one or more components of the suction cover assembly 170 (e.g., the seals 180 and/or 182, the suction cover 192, etc.). The suction cover assembly 170 therefore may require less service, which may limit the downtime of the reciprocating pump assembly 100 and/or reduce costs thereby improving the profitability of a well service or other operation utilizing the reciprocating pump assembly 100.

Referring again to FIGS. 3-5, the body 194 of the suction cover 192 includes one or more leakage channels 234 that are configured to channel leakage pressure trapped by the leakage trap 200 to the interface 222 between the face 212 of the suction cover 192 and the face 220 of the suction cover nut 188. More particularly, in some embodiments, each leakage channel 234 includes an end portion 236 that is open to the leakage trap 200 such that the end portion 236 is in fluid communication with the leakage trap 200. Each leakage channel 234 extends through the body 194 from the end portion 236 to an end portion 238 that is open to the interface 222 between the faces 212 and 220 such that the end portion 238 is in fluid communication with the interface 222. Accordingly, each leakage channel 234 fluidly communicates with both the leakage trap 200 and the interface 222 such that the leakage channel is configured to channel leakage pressure from the leakage trap 200 to the interface 222. The seal 226 held between the suction cover 192 and the suction cover nut 188 facilitates holding the leakage pressure within the interface 222. In the exemplary embodiment illustrated herein, the body 194 of the suction cover 192 includes two leakage channels 234, but the suction cover 192 may include any other number of leakage channels 234, for example a single leakage channel 234 or three or more leakage channels 234.

The leakage pressure channeled to the interface 222 by the leakage channels 234 exerts a force on the face 212 of the suction cover 192 in the direction of the arrow 240. The force exerted on the face 212 of the suction cover 192 by the leakage pressure within the interface 222 holds the seat surface 208 of the flange 206 of the suction cover 192 in physical contact with the seat 210 of the access port 166 to thereby hold the suction cover 192 against the seat 210.

The leakage pressure channeled to the interface 222 by the leakage channels 234 exerts a force on the face 220 of the suction cover nut 188 in the direction of the arrow 242. The force exerted on the face 220 of the suction cover nut 188 by the leakage pressure within the interface 222 exerts an interlocking force on the threads 184 and 186 of the access port 166 and the suction cover nut 188, respectively, that preloads the threads 184 and 186. The preload exerted on the threads 184 and 186 by the leakage pressure channeled to the interface 222 reduces the range of thread root stress experienced by the threads 184 and 186 during cycling of the plunger 114 of the reciprocating pump assembly 100 between the higher pressure discharge stroke and the lower pressure suction stroke, which may increase the fatigue life of the threads 184 and 186. For example, the preload exerted on the threads 184 and 186 by the leakage pressure may reduce the range of Von Mises thread root stress experienced by the threads 184 and 186 from a range of between approximately zero pounds per square inch (psi) and approximately 80,000 psi to a range of between approximately 60,000 psi and approximately 80,000 psi.

The increase of the fatigue life of the threads 184 and 186 may extend the life of the suction cover nut 192 such that the suction cover assembly 170 may require less service, which may limit the downtime of the reciprocating pump assembly 100 and/or reduce costs thereby improving the profitability of a well service or other operation utilizing the reciprocating pump assembly 100.

In some embodiments, the threads 184 and/or 186 are shot peened (e.g., double shot peened, etc.), heat treated, and/or subjected to one or more other hardening techniques to facilitate increasing the fatigue life of the threads 184 and/or 186.

In the exemplary embodiment illustrated herein, the forces exerted by the leakage pressure within the interface 222 on the faces 212 and 220 act in respective directions 240 and 242 that are approximately parallel (i.e., at approximately 0°) to the central longitudinal axis 190 of the suction cover assembly 170. But, the forces exerted by the leakage pressure within the interface 222 on the faces 212 and 220 each may act in any other direction (e.g., an angle of between approximately 0° and approximately 60°, etc.) relative to the central longitudinal axis 190 that enables the suction cover assembly 170 to function as described and/or illustrated herein, for example by changing the orientation of the faces 212 and 220.

The pressure lock of the seals 180 and 182 and/or the forces exerted on the faces 212 and 220 by the leakage pressure channeled to the interface 222 may make it difficult and/or time-consuming to remove the suction cover nut 188 from the access port 166 of the fluid cylinder 108, which may increase a downtime of the reciprocating pump assembly 100. For example, the pressure lock of the seals 180 and 182 and/or the leakage pressure contained within the interface 222 may increase the effort, and therefore possibly the length of time, required to unthread the suction cover nut 188 from the access port 166. In another example, the pressure lock of the seals 180 and 182 and/or the leakage pressure contained within the interface 222 may make it impossible to unthread the suction cover nut 188 such that the user must wait until the leakage pressure naturally leaks out from between the seals 180 and 182 and/or from within the interface 222 (which may take as long as one or more hours) before the suction cover nut 188 is capable of being removed from the access port 166.

Accordingly, the suction cover nut 188 optionally includes a bleed-off valve 244 that is configured to release the leakage pressure from the interface 222 and from the leakage trap 200. More particularly, as shown in FIGS. 3-5, the bleed-off valve 244 is fluidly connected to the interface 222 via a channel 246 such that the leakage pressure within the interface 222 and the leakage trap 200 is vented to the atmosphere when the bleed-off valve 244 is opened. The bleed-off valve 244 therefore may enable a user to immediately remove the suction cover nut 188 from the access port 166 of the fluid cylinder 108 and with less effort, which may limit the downtime of the reciprocating pump assembly 100 and thereby improve the profitability of a well service or other operation utilizing the reciprocating pump assembly 100.

Figure 7:
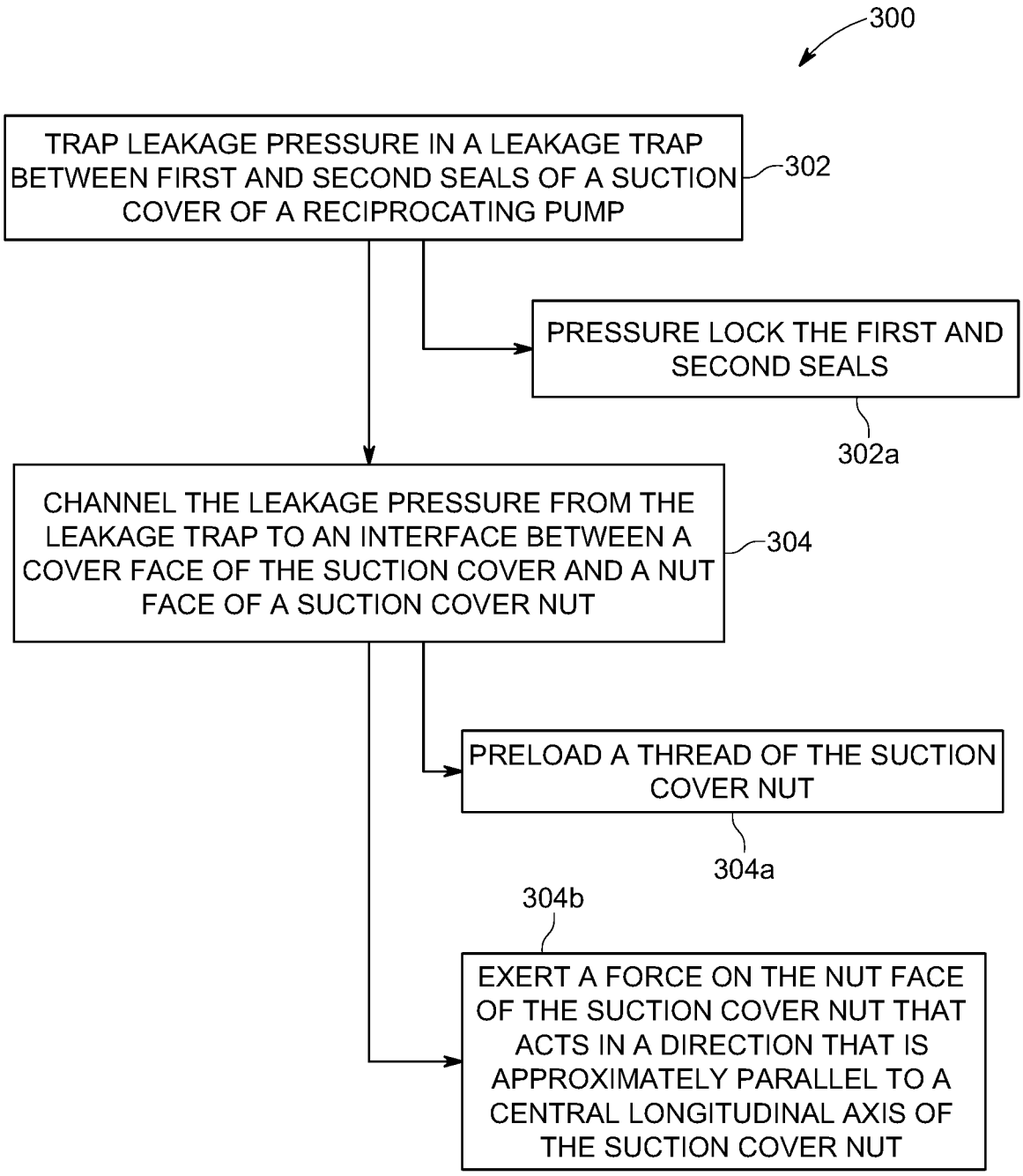
FIG. 7 is an exemplary flowchart illustrating a method for operating a reciprocating pump, according to some embodiments.

Referring now to FIG. 7, a method 300 for operating a reciprocating pump accordingly to an exemplary embodiment is shown. At step 302, the method 300 includes trapping leakage pressure in a leakage trap between first and second seals of a suction cover of the reciprocating pump. In one embodiment, trapping at 302 leakage pressure in the leakage trap includes pressure locking, at 302*a*, the first and second seals.

At step 304, the method 300 includes channeling the leakage pressure from the leakage trap to an interface between a cover face of the suction cover and a nut face of a suction cover nut of the reciprocating pump. In some embodiments, channeling at 304 the leakage pressure from the leakage trap to the interface between the cover face and the nut face includes preloading, at step 304*a*, a thread of the suction cover nut. Optionally, channeling at 304 the leakage pressure from the leakage trap to the interface between the cover face and the nut face includes exerting, at 304*b*, a force on the nut face of the suction cover nut that acts in a direction that is approximately parallel to a central longitudinal axis of the suction cover nut.

EXAMPLES

A Fatigue Life Study using FEA analysis of a Weir SPM® QEM3000 5" SS Fluid Cylinder standard suction cover nut buttress threads was performed versus the embodiments of suction cover nuts described and/or illustrated herein. Three-dimensional (3D) models used in this study represent the QEM3000 5" design with its 7.75"~3 Britt Modified-2B Buttress Suction Cover Nut thread using 4340 steel for the nut and 15-5 stainless steel for the fluid cylinder. Other examples may use different grates or alloys of steel. In some examples, both the male and female threads used are double-shot peened and heat treated for low temperature service.

In some examples, the pressure lock between the two seals eliminated the wear on the fluid cylinder that eventually results in a washout failure. For some new mud pumps that were tested with the dual-seal design, the fretting effect of the seals, and resulting washout on the fluid cylinder, was substantially reduced and/or totally eliminated by the use of two seals. In some examples, the embodiments of the suction cover nuts described and/or illustrated herein may significantly increase the fatigue life of threads in the piston.

In one example, shown in FIG. 8, the fatigue life of the standard suction cover assembly design (made from 4340 steel) with the male thread at 97 RPM and 15,000 psi pumping pressure, with nut-thread root Von Mises stress of 80,000 psi, as established by FEA, is 18.7 hours and increases to 2,061 hours for the suction cover assembly embodiments described and/or illustrated herein (referred to as the "Jacoby" design in the table of FIG. 8). For the female thread in the Weir SPM® SS QEM3000 5" Fluid Cylinder, the fatigue life at 97 RPM and 15,000 psi pumping pressure, with thread root Von Mises stress of 64,375 psi, as established by FEA, increased from 18.9 hours for the standard suction cover assembly design to 26,116 hours for the suction cover assembly embodiments described and/or illustrated herein.

In the example of FIG. 8, the loaded face of the Buttress thread is assumed to be a $2^{nd}$ degree curve instead of a $3^{rd}$ degree curve. If the direction of the helical thread cut is opposite on the two components (on the 3D model used for FEA, or on the actual thread as made by manufacturing), then the two surfaces contacting will both be convex. This results in Hertz Contact Stresses higher than with a normal full face contact. Point contact, on a highly loaded assembly, increases the difficulty of FEA parsing. The male and female threads may, in some examples, be concave on one thread and convex on the opposing thread in order for the entire load distribution to be evenly distributed over the load bearing area of the thread faces. The 3D models used in the example of FIG. 8 were made with opposite thread directions, and this is the case, in some examples, in manufacturing (that the male and female threads are threaded in opposite helical directions). Correcting this in manufacturing has shown to increase the life of the threads. Accordingly, a new set of models were made with threads cut in the same helical direction on the male and female threads in order to get a more accurate root stress. The corrected models resolved and converged in the FEA process much quicker than the ones modeled with the threads cut in the opposite helical direction (down from 24 hours processing time to 2 hours processing time).

Figure 9:
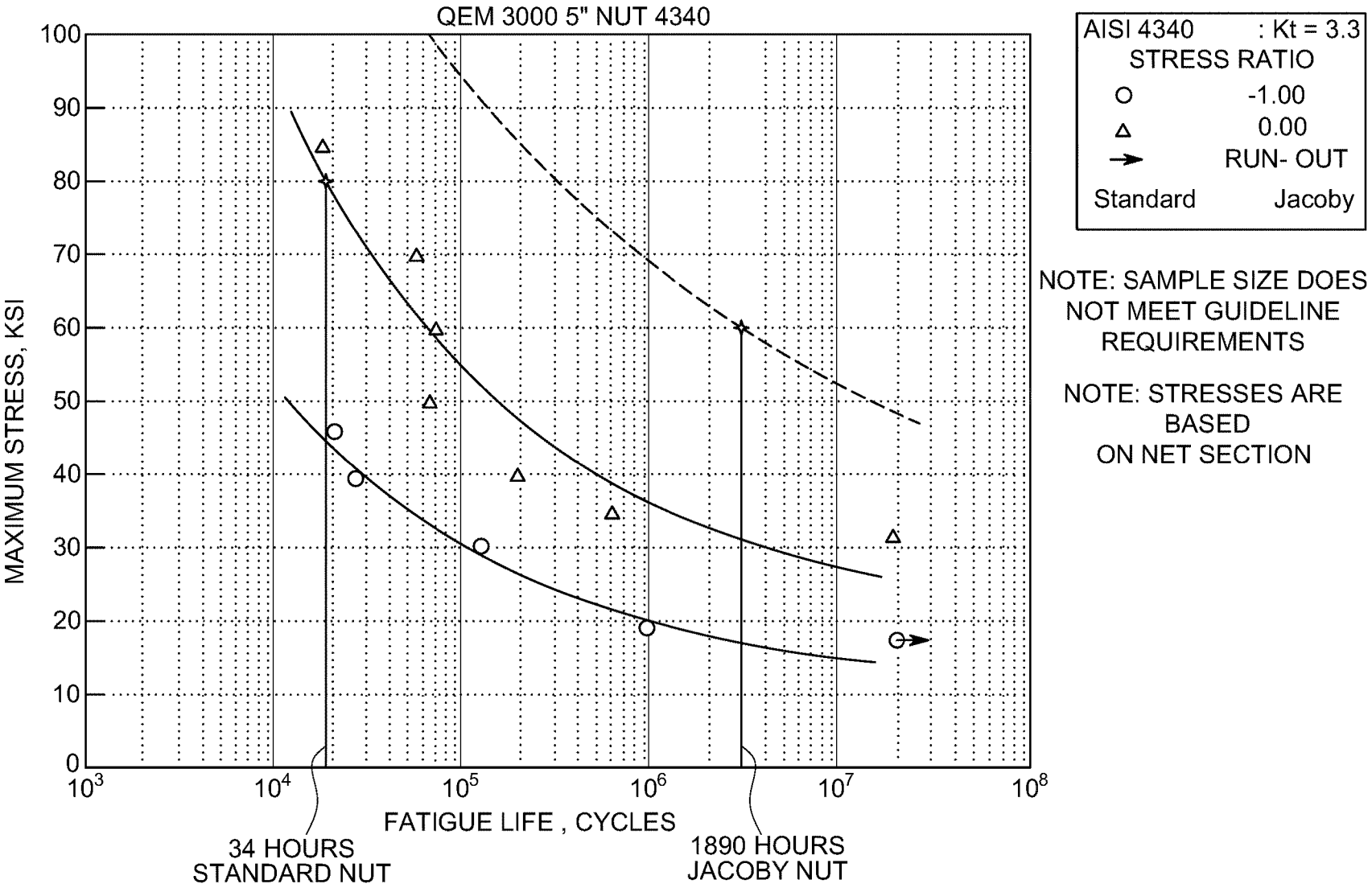
FIGS. 9 and 10 are graphs illustrating the results of another fatigue life study comparing the suction cover assembly embodiments described and/or illustrated herein with a standard suction cover assembly design, according to some embodiments.
Figure 10:
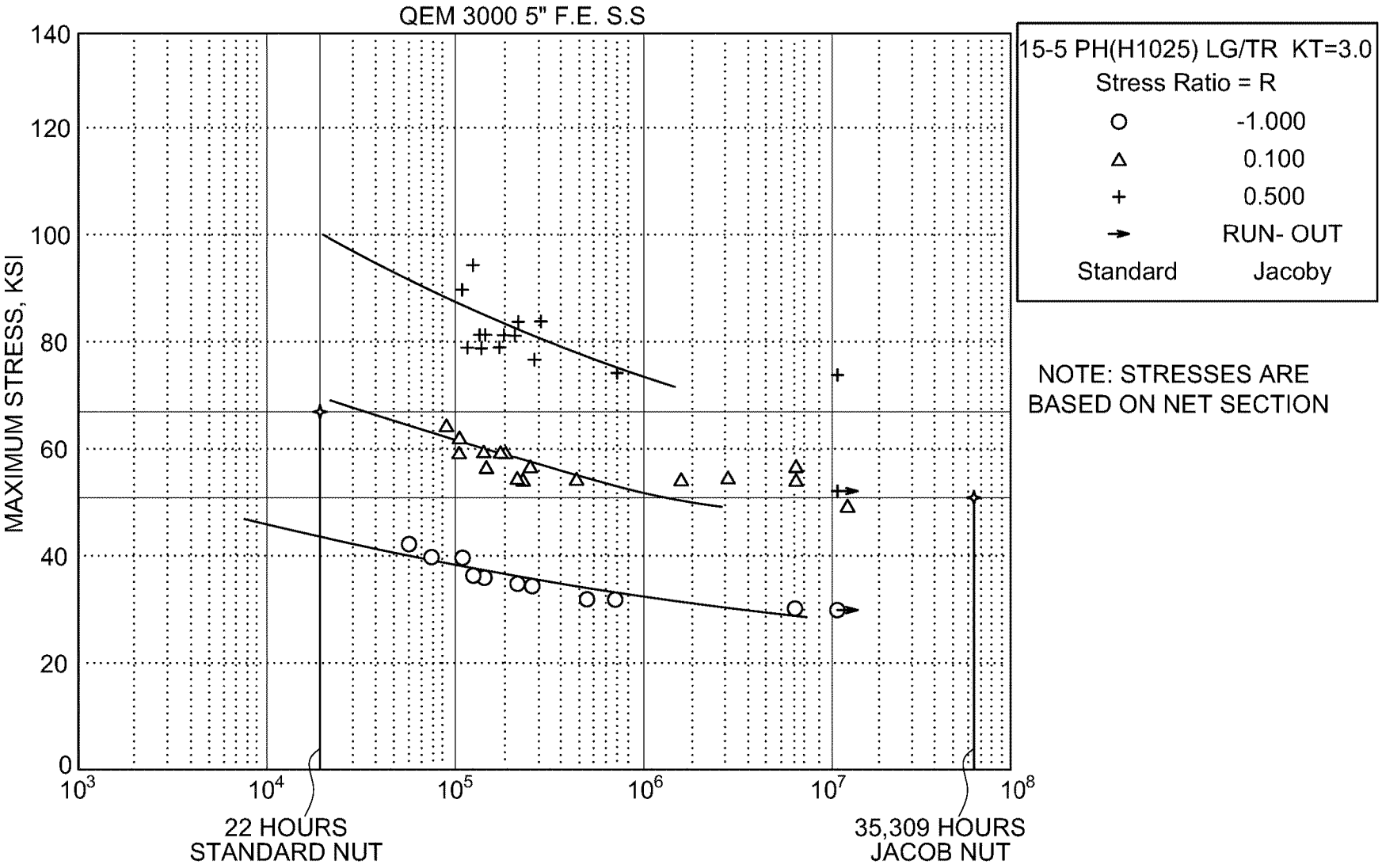

In another example, shown in FIGS. 9 and 10, a fatigue life study was performed using 3D models made with threads cut in the same helical direction, wherein the fatigue life of the standard suction cover assembly design (made from 4340 steel) with the male thread at 97 RPM and 15,000 psi pumping pressure, with nut-thread root Von Mises stress of 80,000 psi, as established by FEA, is 34 hours and increases to 1,890 hours for the suction cover assembly embodiments described and/or illustrated herein (referred to as the "Jacoby" design in the fatigue life curves shown in FIG. 9). For the female thread in the Weir SPM® SS QEM3000 5" Fluid Cylinder, the fatigue life at 97 RPM and 15,000 psi pumping pressure, with thread root Von Mises stress of 67,500 psi, as established by FEA, increased from 22 hours for the standard suction cover assembly design to 35,309 hours for the suction cover assembly embodiments described and/or illustrated herein (referred to as the "Jacoby" design in the fatigue life curves shown in FIG. 10).

It is to be understood that the above description is intended to be illustrative, and not restrictive. For example, the above-described embodiments (and/or aspects thereof) may be used in combination with each other. Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Further, each independent feature or component of any given assembly may constitute an additional embodiment. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "clockwise" and "counterclockwise", "left" and right", "front" and "rear", "above" and "below" and the like are used as words of convenience to provide reference points and are not to be construed as limiting terms.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. For example, in this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised", "comprises", "having", "has", "includes", and "including" where they appear. The term "exemplary" is intended to mean "an example of" The phrase "one or more of the following: A, B, and C" means "at least one of A and/or at least one of B and/or at least one of C." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Although the terms "step" and/or "block" may be used herein to connote different elements of methods employed, the terms should not be interpreted as implying any particular order among or between various steps herein disclosed unless and except when the order of individual steps is explicitly described. The order of execution or performance of the operations in examples of the disclosure illustrated and described herein is not essential, unless otherwise specified. The operations may be performed in any order, unless otherwise specified, and examples of the disclosure may include additional or fewer operations than those disclosed herein. It is therefore contemplated that executing or performing a particular operation before, contemporaneously with, or after another operation is within the scope of aspects of the disclosure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A suction cover assembly for a reciprocating pump, the suction cover assembly comprising:

a suction cover nut having a thread configured to threadably connect the suction cover nut to a fluid cylinder of the reciprocating pump, the suction cover nut having a nut face; and a suction cover having a cover face, the suction cover configured to be supported by the fluid cylinder such that the cover face opposes the nut face of the suction cover nut, the suction cover further including:

a first seal and a second seal forming a leakage trap defined therebetween, the first seal and the second seal are configured to trap a leakage pressure within the leakage trap during operation of the reciprocating pump; and at least one leakage channel having a first end portion in fluid communication with the leakage trap and a second end portion in fluid communication with an interface directly between the cover face and the nut face, the leakage channel extending through the cover face between the first end portion and the second end portion to channel the leakage pressure from the leakage trap to the interface directly between the cover face and the nut face during the operation of the reciprocating pump to exert an interlocking force on and preload the thread of the suction cover nut by channeling.

2. The suction cover assembly of claim 1, wherein the leakage pressure trapped by the leakage trap is configured to pressure lock the first seal and the second seal.

3. The suction cover assembly of claim 1, wherein the suction cover assembly extends along a central longitudinal axis, the leakage pressure being configured to exert a force on the nut face of the suction cover nut that acts in a direction that is approximately parallel to the central longitudinal axis.

4. The suction cover assembly of claim 1, wherein the suction cover nut comprises a bleed-off valve configured to release the leakage pressure from the interface directly between the cover face and the nut face.

5. The suction cover assembly of claim 1, further comprising a third seal held between the suction cover and the suction cover nut such that the third seal is configured to at least partially seal the interface directly between the cover face and the nut face.

6. The suction cover assembly of claim 1, wherein the suction cover comprises a flange that is configured to engage a seat of the fluid cylinder of the reciprocating pump in response to the suction cover being supported by the fluid cylinder.

7. A reciprocating pump assembly comprising:

a power end portion;

a fluid end portion having a fluid cylinder that includes a pressure chamber and an access port, the access port comprising an access port thread; and a suction cover assembly comprising:

a suction cover nut having a cover nut thread that is interlocked with the access port thread such that the suction cover nut is threadably connected to the access port of the fluid cylinder, the suction cover nut having a nut face; and a suction cover having a cover face, the suction cover being held within the access port of the fluid cylinder such that the cover face opposes the nut face of the suction cover nut, the suction cover having a first seal and a second seal forming a leakage trap therebetween, the leakage trap being configured to trap leakage pressure from the pressure chamber during operation of a reciprocating pump, and the suction cover comprising at least one leakage channel having a first end portion in fluid communication with the leakage trap and a second end portion that extends through the cover face such that the at least one leakage channel is configured to channel the leakage pressure from the leakage trap to an interface directly between the cover face and the nut face during the operation of the reciprocating pump, wherein the at least one leakage channel is configured to channel the leakage pressure from the leakage trap to exert an interlocking force on and preload the cover nut thread by channeling.

8. The reciprocating pump assembly of claim 7, wherein the at least one leakage channel is configured to channel the leakage pressure from the leakage trap to the interface directly between the cover face and the nut face such that the leakage pressure preloads the access port thread.

9. The reciprocating pump assembly of claim 7, wherein the leakage pressure trapped by the leakage trap is configured to pressure lock the first seal and the second seal.

10. The reciprocating pump assembly of claim 7, wherein the suction cover assembly extends along a central longitudinal axis, the leakage pressure being configured to exert a force on the nut face of the suction cover nut that acts in a direction that is approximately parallel to the central longitudinal axis.

11. The suction cover assembly of claim 7, wherein the suction cover nut comprises a bleed-off valve configured to release the leakage pressure from the interface directly between the cover face and the nut face.

12. The suction cover assembly of claim 7, further comprising a third seal held between the suction cover and the suction cover nut such that the third seal is configured to at least partially seal the interface directly between the suction cover and the nut face.

13. The suction cover assembly of claim 7, wherein the suction cover comprises a flange that is configured to engage a seat of the fluid cylinder of the reciprocating pump in response to the suction cover being held by the fluid cylinder.

14. A method for operating a reciprocating pump, the reciprocating pump having a suction cover assembly, the suction cover assembly comprising a suction cover nut threadably connected to a fluid cylinder of the reciprocating pump, a suction cover supported within the fluid cylinder such that a cover face of the suction cover opposes a nut face of the suction cover nut forming an interface directly therebetween, a first seal and a second seal forming a leakage trap defined therebetween, and a leakage channel extending between the leakage trap and the interface disposed directly between the nut face and the cover face, the method comprising:

trapping a leakage pressure in the leakage trap; and channeling the leakage pressure from the leakage trap to the interface directly between the cover face and the nut face to exert an interlocking force on and preload a thread of the suction cover nut by channeling.

15. The method of claim 14, wherein channeling the leakage pressure from the leakage trap to the interface directly between the cover face and the nut face comprises exerting a force on the nut face of the suction cover nut that acts in a direction that is approximately parallel to a central longitudinal axis of the suction cover nut.

16. The method of claim 14, wherein the trapping the leakage pressure in the leakage trap between the first seal and the second seal of the suction cover comprises pressure locking the first seal and the second seal.

17. The method of claim 14, further comprising providing a third seal held between the suction cover and the suction cover nut to at least partially seal the interface directly between the cover face and the nut face.

* * * * *